United States Patent [19]

Hood et al.

[11] 4,217,845

[45] Aug. 19, 1980

[54] TRAILERABLE WATER BALLASTED SAILBOAT

[75] Inventors: Frederick E. Hood; K. Dietrich Empacher, both of Marblehead, Mass.

[73] Assignee: Little Harbor Boat Yard Corporation, Marblehead, Mass.

[21] Appl. No.: 945,541

[22] Filed: Sep. 25, 1978

[51] Int. Cl.[2] ..... B63B 39/03; B63B 43/06

[52] U.S. Cl. ..... 114/125; 114/39; 114/138

[58] Field of Search ..... 114/121, 125, 126, 127, 114/130, 138, 140, 141, 39, 197, 198, 56

[56] References Cited

U.S. PATENT DOCUMENTS

| | | | |
|---|---|---|---|
| 1,924,871 | 8/1933 | Ludington | 114/130 |
| 2,997,974 | 8/1961 | Hamlin | 114/125 |
| 3,381,648 | 5/1968 | Vonck | 114/138 |
| 3,503,358 | 3/1970 | Moesly | 114/125 |
| 3,850,127 | 11/1974 | Thorpe | 114/138 |

*Primary Examiner*—Edward R. Kazenske
*Assistant Examiner*—D. W. Keen
*Attorney, Agent, or Firm*—Kenway & Jenney

[57] ABSTRACT

In the trailerable sailboat disclosed herein, the provision of water ballasting enables the use of a V-bottomed displacement hull shape with substantial deadrise yielding a low-wetted surface are in relation to effective displacement. The water ballasting is provided by sealed structural elements which form, with the hull shell, a ballast tank space which is essentially entirely below the design waterline of the hull shape so as to permit self-filling of the tank space with seawater.

3 Claims, 7 Drawing Figures

TRAILERABLE WATER BALLASTED SAILBOAT

BACKGROUND OF THE INVENTION

The present invention relates to a trailerable sailboat and more particularly to such a sailboat employing water ballasting which, in a relatively light trailerable boat, permits a desirably heavy displacement hull shape.

Various designs have been proposed heretofore for a week-ender type of sailboat which is light enough to be easily trailered by the owner. The requirement of adequate stability, however, has typically caused these earlier designs to be quite flat-bottomed. Unfortunately, the flat-bottomed design contributes to undesirable handling properties and incurs a substantially increased wetted surface area which makes the hull slow in light air despite its light weight.

Among the several objects of the present invention may be noted the provision of a trailerable, cruising sailboat which has good all-around sailing characteristics but which is still light enough so as to be easily trailered by the typical owner. Other objects include the provision of such a sailboat which is relatively fast, handles well, and is of relatively simple and inexpensive construction. Other objects and features will be in part apparent and in part pointed out hereinafter.

SUMMARY OF THE INVENTION

A trailerable sailboat in accordance with the present invention includes a hull having an outer shell contoured to provide, relative to a design waterline, a hull shape with substantial deadrise. Mounted on the hull are a dismountable mast supporting sails to drive the hull and a retractable keel element providing lateral resistance to leeway during sailing. Within the hull shell are sealed structure elements which form, with the shell, at least one ballast tank space, the essential bulk of the tank space being below the design waterline of the hull shape. Means are provided for selectively venting the tank space to admit seawater from outside the shell. The weight of the unballasted boat is sufficient to sink the hull to the design waterline when the tank space is vented thereby essentially filling the tank space. Accordingly, with the tank space filled, the ballasting thereby obtained adds substantial form stability to the hull.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
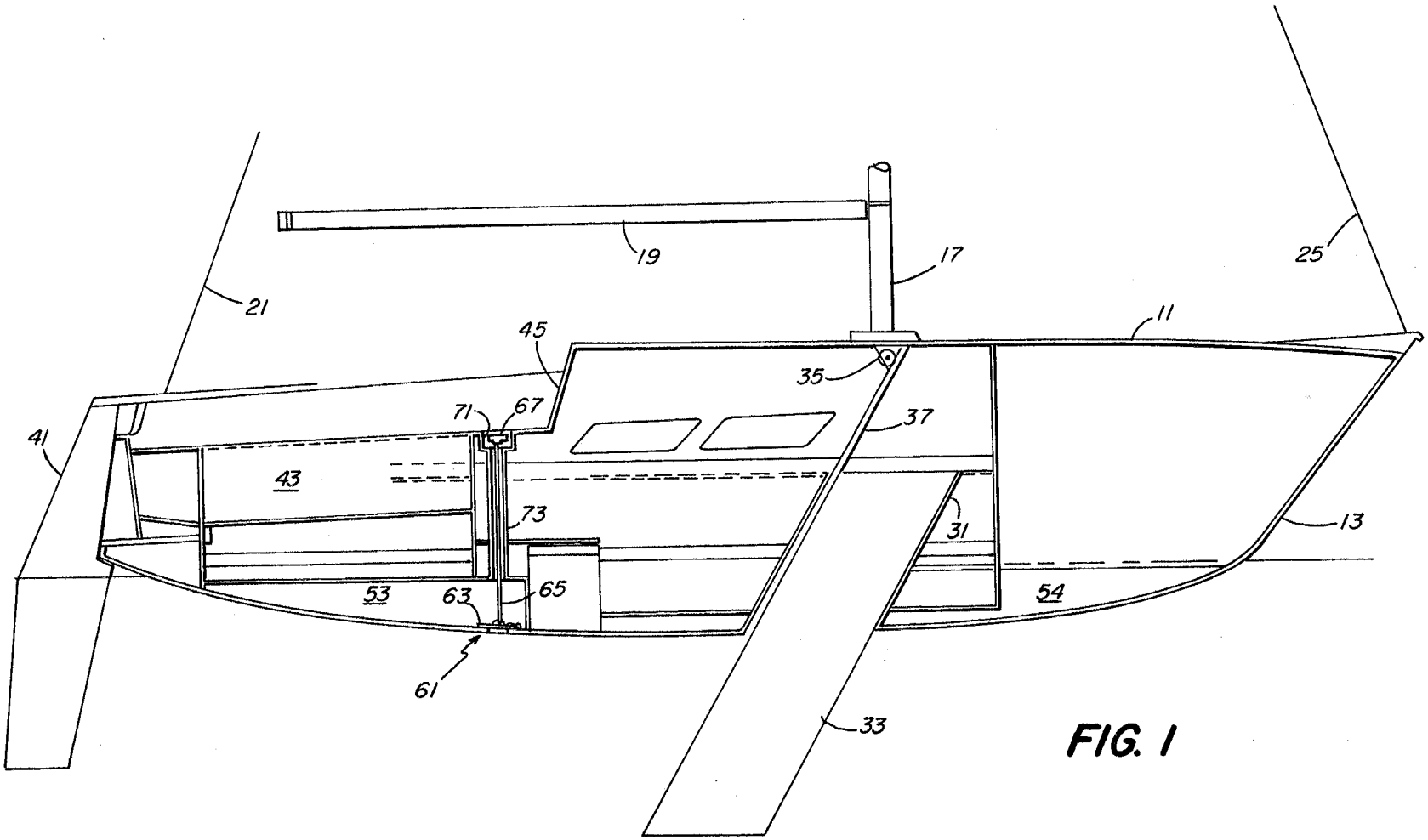
FIG. 1 is a side view with portions broken away of a trailerable water ballasted sailboat constructed in accordance with the present invention.
Figure 2:
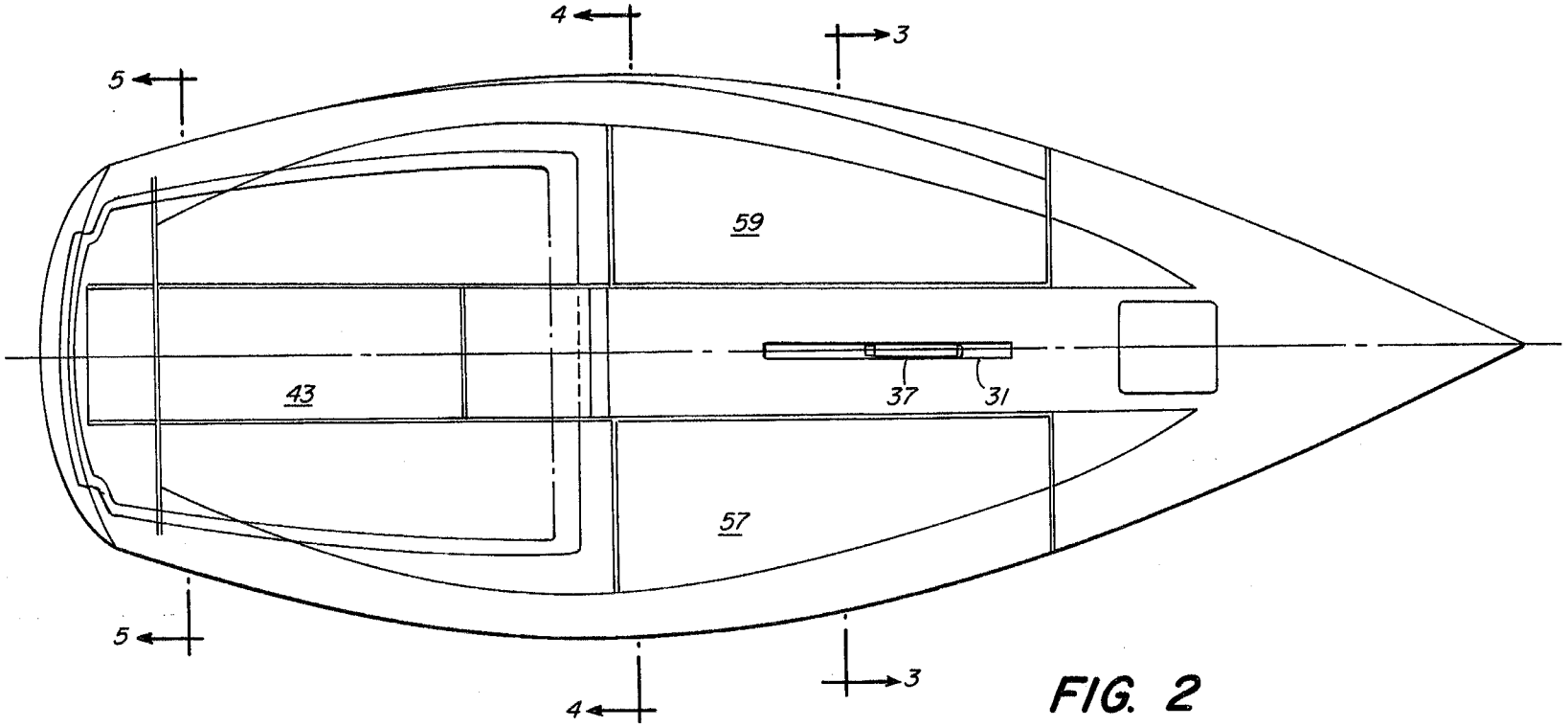
FIG. 2 is a plan view, with portions broken away of the sailboat of FIG. 1.
Figure 3:
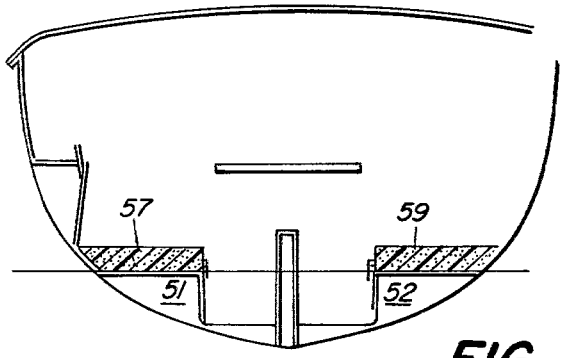
FIGS. 3, 4, and 5 are cross-sectional views taken substantially on the lines 3—3; 4—4; and 5—5 of FIG. 2.
Figure 4:
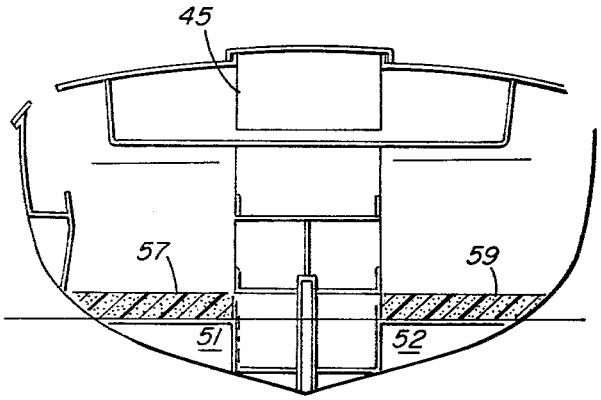
Figure 5:
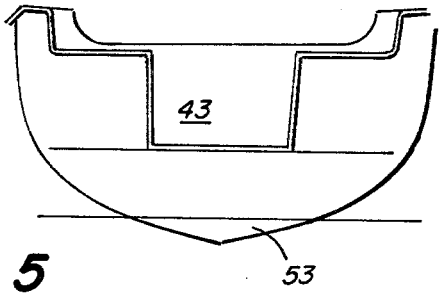

Referring now to FIGS. 1 and 2, there is illustrated a cruising sailboat constructed in accordance with the present invention. A molded fiberglass hull shell 13 forms the bottom and topsides. A deck molding 15 is joined to the hull shell 13 to form the main boat body.

Mounted on the deck 15 is a mast 17 together with a boom 19 and supporting stays 21–25. The mast, boom and rigging support sails for driving the hull.

Within the hull is formed a dagger board trunk 31. Through trunk 31, a dagger board 33 can be extended from the bottom of the hull to provide lateral resistance to leeway during sailing, i.e. when beating to windward. A block and tackle lift mechanism 35 is provided for manually raising the dagger board. Beam structure 37 preferably continues upwardly from the dagger board trunk 31 so as to provide additional support for the deck molding 15 near the mast step, as shown.

A rudder 41 is mounted on the transom of the hull for steering and a conventional cockpit 43 is provided aft. At the forward end of the cockpit 43 is a hatchway 45 through which access may be had to the cabin space between the deck and hull moldings.

Partitions and bulkheads are provided within the hull shell 13 so as to form, with the hull shell, tank spaces 51–54 which are adjacent the bottom of the hull and below the design waterline. A preferred arrangement of these bulkheads provides lateral tank spaces 51 and 52 on either side of the main cabin space with more central tank spaces 53 and 54 being provided fore and aft as illustrated in the drawings.

The tops of the side tank spaces 51 and 52 are preferably flat to provide a base for bunk cushions 57 and 58 with a leg space 59 between the lateral tank spaces, i.e. at the deepest part of the hull. Though not illustrated, it should be understood that further interior embellishments may be provided, e.g, a table extending aft from the dagger board trunk between the bunks, a galley adjacent the hatchway, and a holder for a portable, chemical toilet in the bow space forward of the dagger board trunk.

Figure 6:
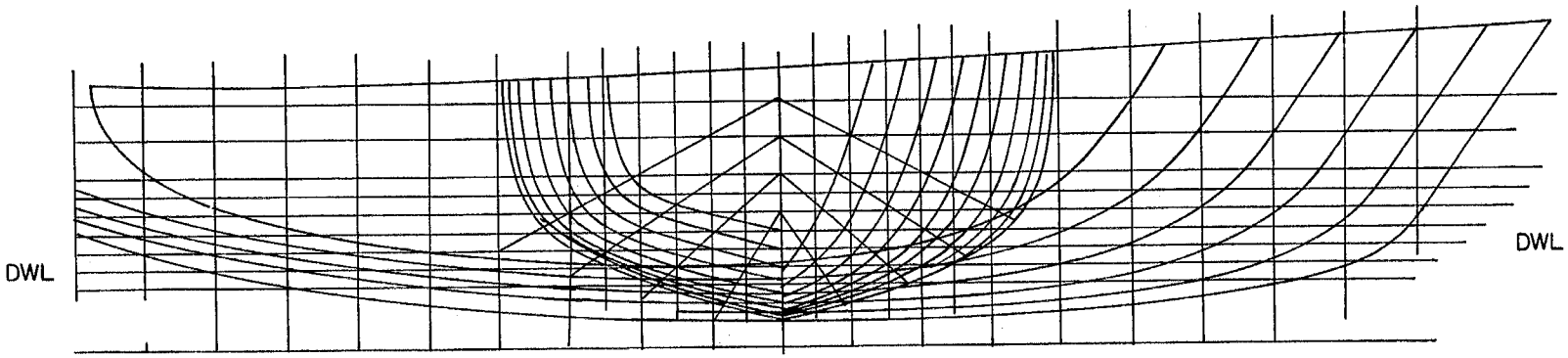
FIGS. 6 and 7 are hull line drawings to scale showing the hull form of the sailboat of FIG. 1.
Figure 7:
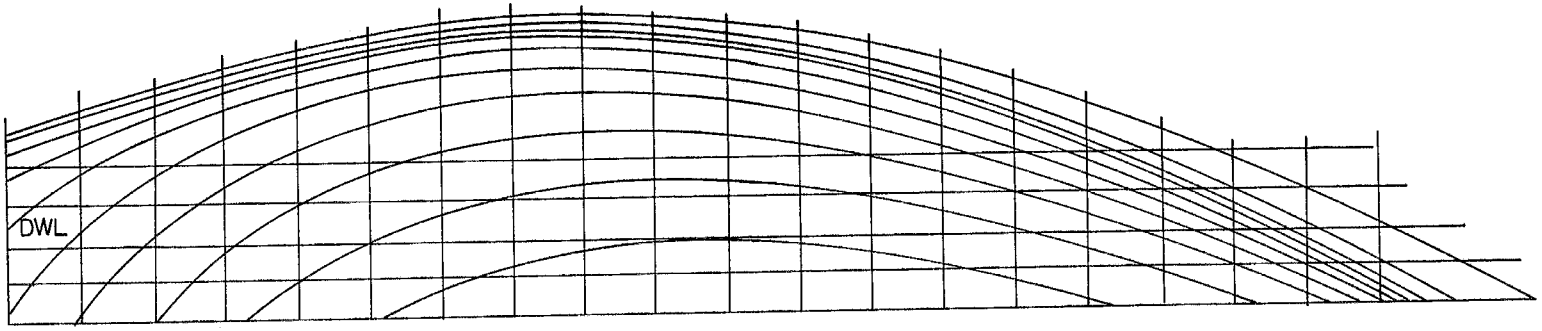

The hull lines are represented in conventional fashion in FIGS. 6 and 7. As will be seen by those skilled in the art, the hull is a displacement shape, i.e. a design utilizing substantial deadrise so as to provide significant displacement in relation to wetted surface. While the preferred design illustrated may be classified as a V-bottomed hull, it should be understood that a more rounded bottom might also be used. In either case, the important distinction is that the hull departs significantly from those designs which would be considered flat-bottomed and which incur a substantial wetted surface penalty in relation to their displacements. This hull design, assuming a 21-foot length overall, provides the displacement of about 2500 pounds. A weight of 2500 pounds, however, is considered excessive for acceptable consumer trailerability. It should further be understood that, utilizing modern construction techniques, the materials required to construct a sailboat of the design illustrated is likewise considerably under 2500 pounds.

In accordance with the present invention, the sailboat is constructed to weigh approximately 1800 pounds including daggerboard and the additional 700 pounds of displacement is obtained by water ballasting, i.e. filling the tank spaces 51–54 with seawater. It should be understood that the term seawater is used in a generic sense to mean the water in which the boat is to be sailed, whether saltwater or fresh.

The tank spaces 51–54 are constructed so as to be open to each other and a water inlet 61 is provided through the bottom of the hull at a point adjacent the forward end of the cockpit 43. The inlet opening through the hull is normally closed by a flapper-type valve element 63. Flapper element 63 may be opened to drain the tank spaces when the boat is hauled by means of a pull rod 65 extending to a T-handle 67 which is accessible from the cockpit, being set into an appropriate recess 71. Around the rod 65 above the tank space 53 is a vent tube 73 which prevents water in the tank spaces from escaping to the cabin interior and also allows venting of air from the tank spaces when the tank spaces are filling, following a launch. Preferably, the pull rod 65 slides freely in the vent tube 73 so that, upon launching, the flap valve 63 will open automatically and thereby assure that the tank spaces are filled without operator intervention. Preferably, additional vents are provided from the high points of each of the other tank spaces to a level well above the water line to assure that each of the tank spaces will completely fill and that there will be no free water surface during sailing. These vents may be merely simple connections to flexible PVC tubing (not shown in the drawings) as is normally used for venting drinking water tanks.

When the sailboat is launched, the valve element 63 opens and the tank spaces are allowed to self-fill. The tops of all the tank surfaces are below the design waterline and the weight of the hull is sufficient to sink the hull to the design waterline. Accordingly, the tank spaces will essentially completely fill and all air will vent through the standpipe. When sailing, the valve 65 closes so that water cannot drain from the tank spaces when the sailboat is heeled, even though some portions of the tanks will clearly be lifted above the outside water surface. As will be understood by those skilled in the art, this lifting contributes to the righting moment of the sailboat.

In that the hull design utilizes a deadrise angle of about 30 degrees, the sinking of the hull to the design waterline by water ballasting adds dramatically to the overall stability of the boat. This can also be noted by comparing the design waterline beam of about 70.5 inches with the waterline beam of about 63 inches which would exit if the hull were floated without water ballasting. In fact, in experiments without water ballasting, the hull was found to be highly unstable and it was virtually impossible for an adult male to stand on the beam rail. However, with the water-ballasting, the boat is relatively stiff, both in terms of being able to comfortably walk about on deck and in sailing to windward.

While the design provides highly useful stiffness and stability as described above, it does not do so at the expense of incurring a large wetted surface as would be the case with a flat-bottomed design. Thus, the boat sails well to windward even in light airs and tends to exhibit favorable handling and directional stability.

On hauling the boat for trailering, the valve 65 is opened and the water is allowed to drain so that only the weight of the bare hull with accessories needs to be trailered. The dry weight of 1800 pounds allows this vessel to be trailered even behind compact cars and its overall length of 21 feet and overall beam of slightly less than eight feet makes such use entirely practical and permissible in any state.

In view of the foregoing, it may be seen that several objects of the present invention are achieved and other advantages results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. An owner trailerable displacement hull sailboat comprising:

a hull of length about 20 feet and beam about 8 feet including an outer shell contoured to provide, relative to a design waterline, a V-bottomed displacement hull shape with substantial displacement in relation to wetted surface;

a dismountable mast for supporting sails to drive said hull;

a retractable keel element located at the hull centerline for providing lateral resistance to leeway during sailing;

within said shell, sealed structural wall elements which form, with said shell, a pair of ballast tank spaces, one on either side of the hull with a walkway between them, the essential bulk of the tank spaces being below the design waterline of the hull shape; and inlet means through the bottom of said shell below said design waterline for filling said tank spaces to admit sea water from outside the shell, the weight of the unballasted boat being sufficient to sink the hull to the design waterline and essentially fill said tank spaces, the V-ing of the hull bottom being such that the waterline beam without ballasting is about 63 inches and the waterline beam when the hull is water ballasted is about 70 inches, whereby ballasting adds substantial form stability to the hull.

2. An owner trailerable displacement hull sailboat comprising:

a hull including an outer shell contoured to provide relative to a design waterline, a V-bottomed displacement hull shape with substantial displacement in relation to wetted surface;

a dismountable mast for supporting sails to drive said hull;

a retractable keel element located at the hull centerline for providing lateral resistance to leeway during sailing;

within said shell, sealed structural wall elements which form, with said shell, a pair of ballast tank spaces, one on either side of the hull with a walkway between them, the essential bulk of the tank spaces being below the design waterline of the hull shape; and inlet means through the bottom of said shell below said design waterline for filling said tank spaces to admit sea water from outside the shell, the weight of the unballasted boat being sufficient to sink the hull to the design water line and essentially fill said tank spaces, the V-ing of the hull bottom being such that the deadrise angle at the design waterline maximum beam is about 30 degrees, whereby ballasting adds substantial form stability to the hull.

3. A trailerable displacement hull sailboat comprising:

a hull including an outer shell contoured to provide, relative to a design waterline, a V-bottomed displacement hull shape with substantial displacement in relation to wetted surface;

a dismountable mast for supporting sails to drive said hull;

a retractable keel element located at the hull centerline for providing lateral resistance to leeway during sailing;

within said shell, sealed structural wall elements which form, with said shell, a pair of ballast tank spaces, one on either side of the hull with a walkway between them, the essential bulk of the tank spaces being below the design waterline of the hull shape; and inlet means through the bottom of said shell below said design waterline for filling said tank spaces to admit sea water from outside the shell, the weight of the unballasted boat being sufficient to sink the hull to the design water line and essentially fill said tank spaces, the V-ing of the hull bottom being such that, without ballasting, the waterline beam is about 90% of the waterline beam when ballasted, whereby ballasting adds substantial form stability to the hull.

* * * * *